United States Patent [19]

Lopez

[11] 4,074,459

[45] Feb. 21, 1978

[54] TOY BALLERINA DOLL

[76] Inventor: Ana Lopez, GPO Box 329, New York, N.Y. 10001

[21] Appl. No.: 768,088

[22] Filed: Feb. 14, 1977

[51] Int. Cl.[2] ..... A63H 13/02

[52] U.S. Cl. ..... 46/47; 46/62; 46/138

[58] Field of Search ..... 46/62, 63, 136, 138, 46/140, 47

[56] References Cited

U.S. PATENT DOCUMENTS

| | | | |
|---|---|---|---|
| 108,170 | 10/1870 | Nicholson | 46/62 X |
| 643,426 | 2/1900 | Tamzarian | 46/62 |
| 2,397,674 | 4/1946 | Loomis | 46/63 |
| 2,533,935 | 12/1950 | Herzog | 46/47 |
| 3,052,060 | 9/1962 | Wohlstrom | 46/62 X |

FOREIGN PATENT DOCUMENTS

| | | | |
|---|---|---|---|
| 59,038 | 9/1941 | Denmark | 46/47 |
| 1,009,087 | 2/1952 | France | 46/47 |
| 329,071 | 5/1958 | Switzerland | 46/138 |

*Primary Examiner*—F. Barry Shay
*Attorney, Agent, or Firm*—Richard L. Miller

[57] ABSTRACT

A toy that represents a pirouetting ballerina, and which includes a doll mounted along a line extending vertically through a center thereof, the line including a string attached to a rubber band that can be rotationally wound up, so that when the extending opposite ends of the line are grasped and manually pulled, the doll spins reciprocally in opposite directions.

1 Claim, 3 Drawing Figures

TOY BALLERINA DOLL

This invention relates generally to action toys.

A principal object of the present invention is to provide an toy ballerina doll in which a doll dressed like a dancing ballerina pirouettes on her toes so to make an appealing and interesting sight to watch.

Another object is to provide an toy ballerina doll which can be readily operated by anyone and even by small children, as it requires no profound skill.

Yet a further object is to provide an toy ballerina doll which is educational to small children who are thus introduced to skilled art of ballet and who through the simple mechanical principles of the invention are introduced to the laws of natural physics of motion.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

Figure 1:
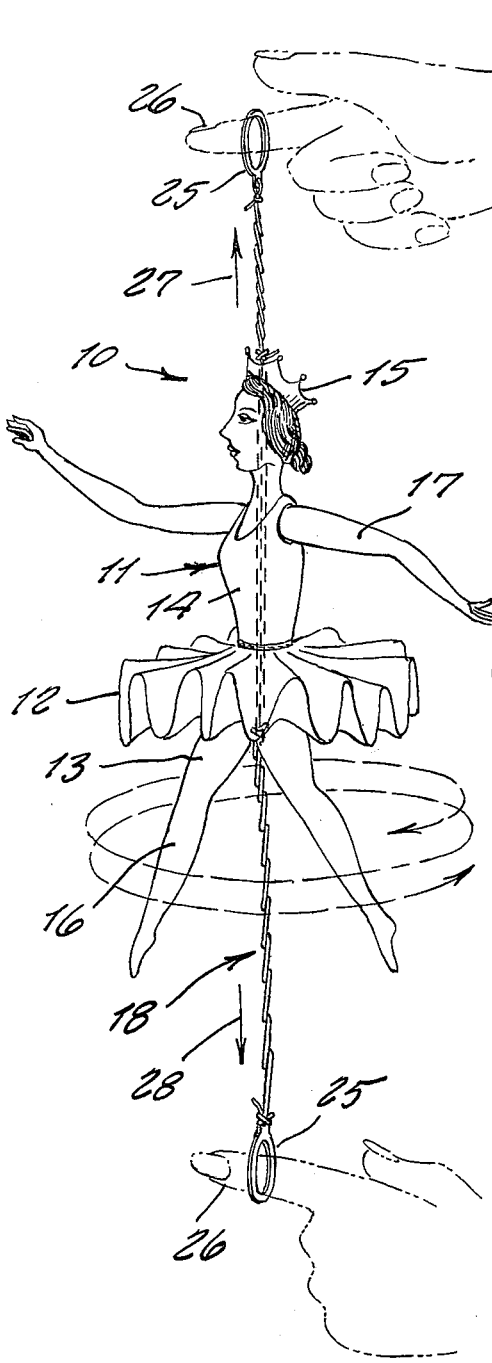
FIG. 1 is a side view of the invention shown in operative use, wound up so the doll rotates.

Referring now to the drawing in detail, the reference numeral 10 represents an toy ballerina doll according to the present invention wherein there is a doll 11 dressed in a garment similar in appearance to that of a ballet dancer and which includes a ruffled skirt 12, leotards 13, bodice 14 and crown 15. The doll includes movable legs and arms 16 and 17 which are placed in a position as shown.

Figure 2:
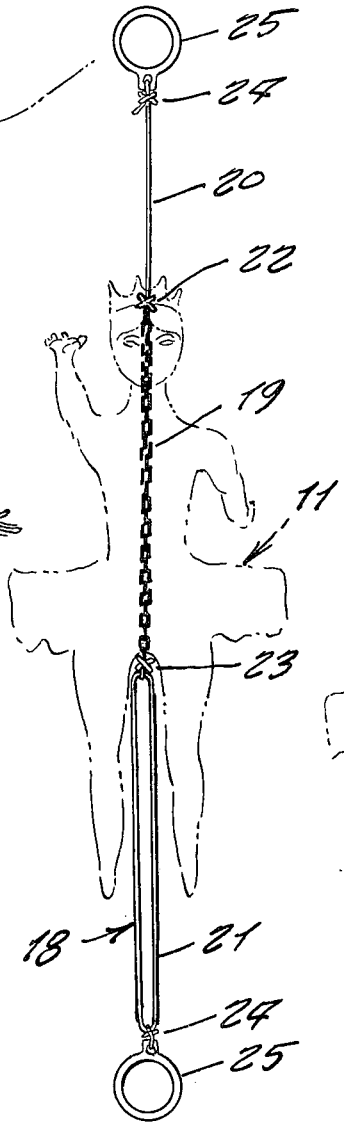
FIG. 2 is a front view thereof, showing the doll in phantom only in order to clearly show the operative structure inside which is here illustrated in unwound position.

The doll is mounted along a flexible line 18 which in FIGS. 1 and 2 is shown to be comprised of a chain 19, a string 20, and a rubber band 21 which are tied together. The chain extends through a center of the doll body from the head to a crotch. The string is tied by a knot 22 to the upper end of the chain while the rubber band is secured by a knot 23 to a lower end of the chain. The free ends of the string and rubber bands are each tied by a knot 24 to a ring 25 which is of a size so that a person can easily grasp the same or else insert a finger 26 therein.

In operative use, the toy is held by two hands as shown in FIG. 1, and the toy is wound up by being swung around a number of times until the rubber band is spirally twisted as shown in FIG. 1. The person then pulls the string and rubber band into opposite, spreading apart directions, as indicated by arrows 27 and 28 which causes the wound up toy to twirl between the end rings 25, thus giving the doll an appearance of pirouetting on her toes like a real ballerina. Reciprocally it twirls in opposite directions as the string and rubber band wind up first in one direction and then in an opposite direction. Pull on the line is stopped at the moment of full unwind and when winding in an opposite direction it commences. Thus the toy is continued to operate.

Figure 3:
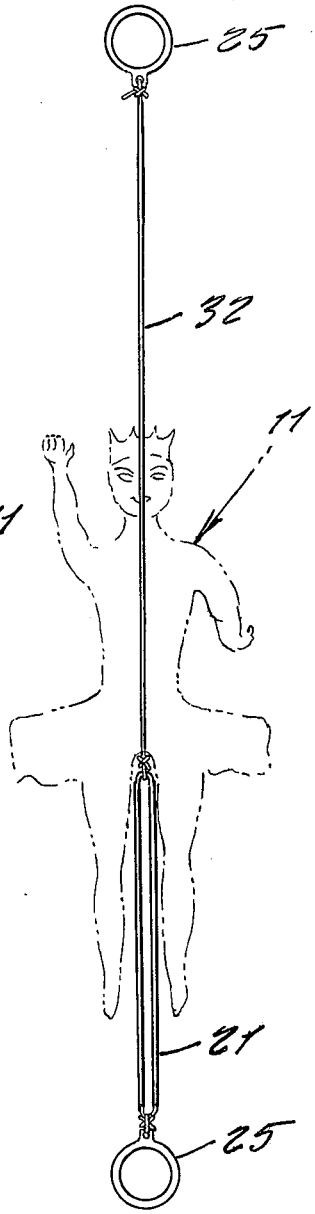
FIG. 3 is a view similar to FIG. 2 and showing a modified construction thereof.

In FIG. 3, a modified construction of toy ballerina doll 30 is the same as the above described design 10 thereof except that instead of the line including a chain as stated, the line 31 in FIG. 3 consists of only a string 32 and rubber band 21, the string extending from the ring 25 through the doll body and being tied directly to the rubber band. Thus no claim is used. The device is operated the same as above described.

While certain novel features of this invention have been shown and described and are pointed out in the annex claims, it will be understood that various omissions, substitutions and changes in the forms and details of the device illustrated and in its operation can be made by those skilled in the art without departing from the spirit of the invention.

What is claimed is:

1. A toy, comprising in combination, a doll mounted along a single line extending through said doll and protruding from upper and lower ends thereof, opposite ends of said line being free and each end being fitted with a ring for being held in hands of an operator, and said opposite ends of said line extending from said doll and being flexible so that they can be wound up; said doll being made in the appearance of a ballerina dancer, said line being comprised of a length of chain, a string and a rubber band, said chain being attached to and contained within said doll and extending from a top of a head thereof, to a crotch thereof, one said extending end of said line comprising said string, and the other said extending end of said line comprising said rubber band, and said doll having movable legs and arms.

* * * * *